United States Patent [19]

Pitchford

[11] 4,310,320

[45] Jan. 12, 1982

[54] ELECTRICAL CONTROL FOR TRIM/TILT OF DUAL OUTBOARD OR STERN DRIVES

[76] Inventor: Robert J. Pitchford, 131 6th St., Fond du Lac, Wis. 54935

[21] Appl. No.: 93,179

[22] Filed: Nov. 13, 1979

[51] Int. Cl.[3] ..... B63H 5/08

[52] U.S. Cl. ..... 440/61; 440/79

[58] Field of Search ..... 440/53, 61, 1, 2, 80, 440/62, 63, 900, 79

[56] References Cited

U.S. PATENT DOCUMENTS

| | | | |
|---|---|---|---|
| 2,999,476 | 9/1961 | Johnson | 440/79 X |
| 3,434,449 | 3/1969 | North | 440/61 X |
| 3,641,965 | 10/1970 | Schmiedel | 440/2 |
| 3,756,186 | 9/1973 | Nordling | 440/79 X |
| 3,881,433 | 5/1975 | Hamp | 440/1 |
| 3,957,011 | 5/1976 | Hurst | 440/61 X |
| 3,999,502 | 12/1976 | Mayer | 440/61 X |
| 4,052,952 | 10/1977 | Hale | 440/61 X |

*Primary Examiner*—Trygve M. Blix
*Assistant Examiner*—John C. Paul

[57] ABSTRACT

An electrical control system for a pair of stern drives (or outboard motors) mounted side-by-side on a boat transom and mechanically linked to tilt them within a trim range to improve operational performance or to tilt them above the trim range to facilitate shallow water navigation, launching or trailing, comprises: a key-operated main switch; three manually operable toggle type (off, up, down) selector switches, namely, a trailer switch, a starboard trim switch, and a port trim switch; and other circuit components. With the main switch off (as when launching or trailing), trailer switch "up" or "down" effects corresponding tilt of both drives simultaneously to a desired position regardless of their initial position and the trim switches are ineffective. With the main switch on (as during boat operation), trailer switch "down" effects down tilt of both drives simultaneously to a desired position regardless of initial position, whereas trailer switch "up" effects up tilt of both drives only if both drives are already above the trim range. If both drives are above the trim range, operation of either trim switch "down" moves both drives simultaneously down, until the trim range is reached; but operation of either trim switch "up" has no effect. If both drives are within the trim range, either trim switch "up" or "down" effects corresponding tilt of the respective drive, but only within the trim range.

11 Claims, 5 Drawing Figures

ELECTRICAL CONTROL FOR TRIM/TILT OF DUAL OUTBOARD OR STERN DRIVES

TECHNICAL FIELD

This invention relates generally to electrical control systems for trimming and tilting dual-mounted outboard motors or stern drives.

BACKGROUND ART

U.S. Pat. Nos. 3,434,449 and 3,641,965, owned by the same assignee as the present application, disclose electrically controlled switch actuated hydraulically powered extendable and retractable trim/tilt cylinders for vertically trimming or tilting individual outboard motors or stern drives to desired angular positions. Such a cylinder, which is supplied with hydraulic operating fluid from a motor driven pump and responds to actuation of a manually operable three position (off, up, down) electrical switch, effects trim positioning of the drive, as during boat operation, and also raises and lowers the drive for clearance purposes. Trimming is carried out within a trim angle or trim range (defined by full down drive position and some higher trim limit position) and changes the angle of propeller thrust thereby causing the boat bow to raise or lower and enables selection of a proper and more efficient angle for different loads or different water conditions or for getting on plane. Tilting or raising the drive up past the trim range for clearance purposes enables safer shallow water running and facilitates launching or trailing.

When two such trimmable/tiltable drives are mounted side-by-side and used to power the same boat, the power pulses from one drive's propeller interact with the other drive and can cause increased wear of drive components and other problems. The effect of this phenomena is diminished by using an external "tie bar" that mechanically and pivotably connects the housings of the two drives together outside of the boat, while at the same time permitting the drives to be moved horizontally for steering purposes by suitable steering means inside or outside of the boat transom. However, since the tie bar does not telescope or change length in any way, damage can be incurred if the aforedescribed trim/tilt cylinders are operated independently to move one drive up or down for a substantial distance while the other drive is still relatively stationary. Nevertheless, because of mechanical tolerances and clearances in the connection of the tie bar to the drives, relatively small differences in drive angle between the adjacent drives are still possible for trim purposes and do not result in damage. Accordingly, anyone operating a dual drive boat with such an external tie bar has to use extreme care to avoid damage to the drives and/or the tie bar when actuating the trim/tilt cylinders for any purpose.

DISCLOSURE OF INVENTION

The present invention provides an improved electrical control system for effecting trim/tilt positioning of a pair of outboard motor drives or stern drives (each type hereinafter called "drives") which are mounted side-by-side on a boat transom, and especially drives which are mechanically interconnected by an external tie rod. The control system presupposes that each drive, which is horizontally pivotably for steering by suitable steering means inside or outside of the boat transom, is also pivotable or tiltable by suitable electrically controllable means about an axis in a generally vertical plane to positions between a full down position and a full up (or "trailer") position and to any position therebetween and that there is a trim angle or trim range between full down position and some trim limit position thereabove.

The electrical control system comprises a main switch, three manually operable toggle type (off, up, down) selector switches (designated trailer, starboard trim, port trim), a pair of trim position limit switches (port and starboard) responsive to the position of their respective drives, a pair of relays, and a plurality of diodes for isolation of the port and starboard circuit functions, as well as to prevent erratic system operation when more than one selector switch is operated at the same time.

With the main switch off (open), the relay coils remain de-energized and their contacts closed because the limit switches, whether open or closed, have no effect on circuit operation and certain diodes prevent energization of the relay coils even if the trailer switch and either or both of the trim switches are actuated simultaneously. Therefore, trailer switch "up" or "down" effects corresponding tilt of both drives simultaneously regardless of their initial position.

With the main switch on (closed), the relays and limit switches become operative. As before, trailer switch "down" effects down tilt of both drives simultaneously regardless of initial position. However, trailer switch "up" effects up tilt of both drives only if both drives are already above the trim range and the limit switches are both open, thereby causing the relay coils to be de-energized and their contacts to be closed. If both drives are above the trim range, either trim switch "down" effects down tilt of both drives simultaneously, until the trim range is reached, whereupon the limit switches close to energize the relays and open the relay contacts. Opening the contacts of one relay isolates the port and starboard control portion of the control circuit. If both drives are within the trim range, either trim switch "up" or "down" effects corresponding tilt only of its respective drive because one relay opens resulting in individual drive control.

The control system is well-adapted for use with drives having electrically controlled hydraulically powered trim/tilt cylinders which are supplied with operating fluid by electric motor driven hydraulic pumps. However, the control system could be employed with other types of electrically controllable devices for effecting trim/tilt positioning of the drives.

An electrical control system in accordance with the present invention offers numerous advantages over the prior art. For example, independent trimming of one drive relative to the other within a small trim range is possible so as to obtain maximum performance efficiency. However, wide angle tilt changes between the two drives is automatically prevented regardless of possible operator misuse of the manually operable selector switches. Furthermore, the number of manually operable switches required to achieve a wide variety of drive positions for dual drive arrangements is reduced, as compared to prior art arrangements, thereby simplifying switch operations. The effect of the main key-operated switch on operation of the three selector switches provides further versatility and safety. Other objects and advantages will hereinafter appear.

BEST MODE FOR CARRYING OUT THE INVENTION

Figure 1:
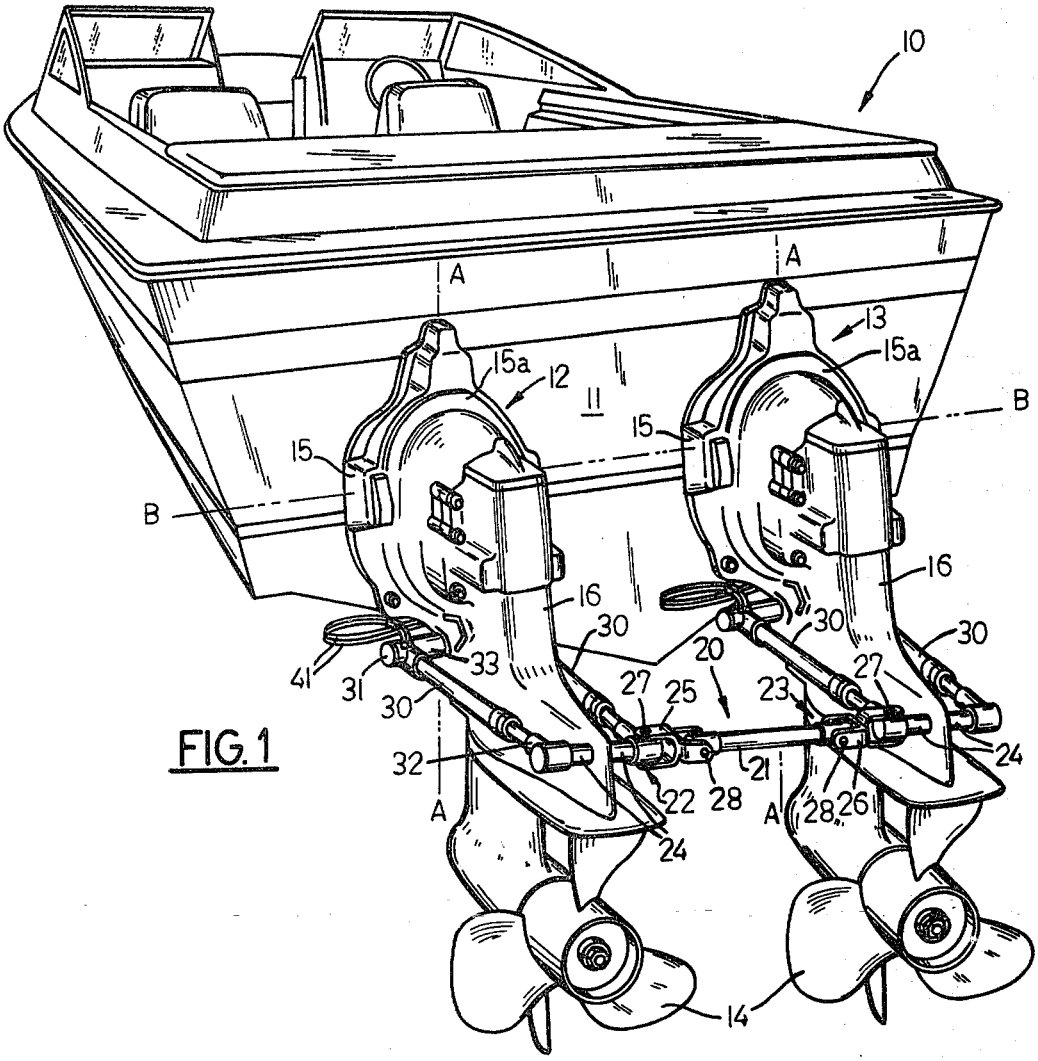
FIG. 1 is a perspective view of the stern of a boat having two mechanically interconnected tiltable propulsion units or drives, such as stern drives, mounted on the exterior of the boat transom.
Figure 2:
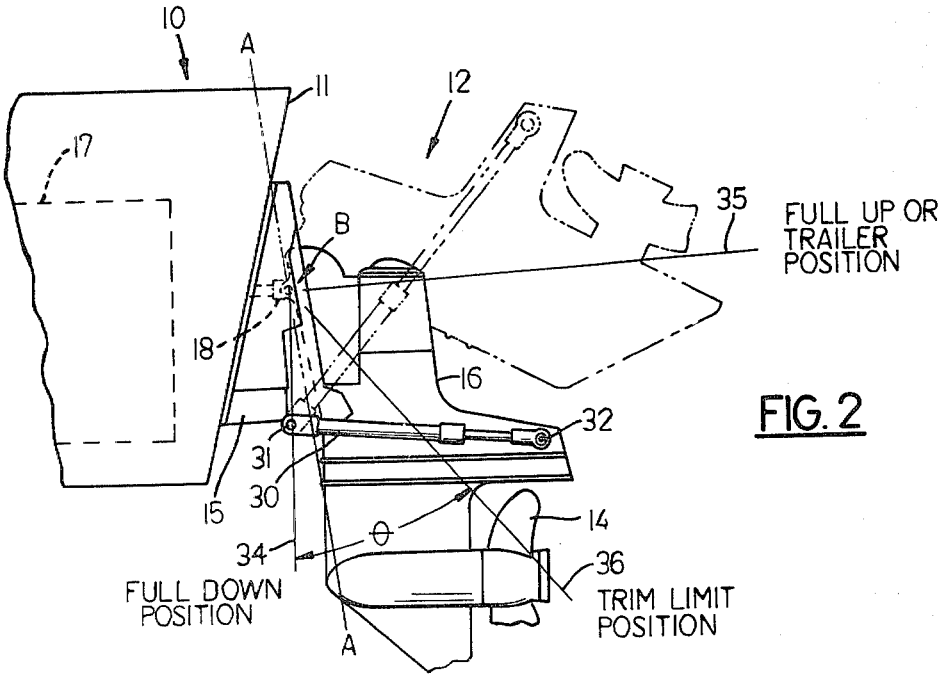
FIG. 2 is a side elevational view of the boat stern and port drive of FIG. 1, showing the drive in full down position and also showing it, in phantom lines, tilted to full up or trailer position.

FIGS. 1 and 2 show a boat 10 having a transom 11 on which a pair of stern drives 12 and 13 are dual-mounted in adjacent side-by-side spaced-apart relationship for propelling the boat. The port and starboard stern drives 12 and 13, respectively, which could take the form of outboard motors, are similar to each other in construction, mode of operation and certain associated components, and, therefore, only port drive 12 is hereinafter described in detail.

Stern drive 12, which includes a drive unit 16 connected to the transom 11 through a transom bracket 15, includes a gimbal ring 15*a* which pivotally supports the drive unit 16 about a vertical axis A—A for steering and about a horizontal axis B—B for trimming. The drive unit 16 includes a propeller 14 which is driven by an engine 17 inside boat 10 by means of a suitable drive train (not shown) which extends through transom bracket 15 and through drive unit 16. A flexible coupling or a universal joint 18 (see FIG. 2) permits the drive unit 16 to move during steering and trimming.

It is to be understood that drive 12 is pivotable to port and starboard about axis A—A for steering purposes by means of a steering linkage (not shown). Drive 12 is also pivotable or tiltable in a vertical direction about axis B—B for trim and tilt purposes, as shown in FIG. 2 and hereinafter explained.

As FIG. 1 shows, the drives 12 and 13 are mechanically interconnected by mechanical means, such as a tie-rod assembly or linkage 20, located exteriorly of transom 11 which serves to overcome or diminish the effects caused by power pulses from the propeller of one drive on the other drive in dual drive systems such as herein disclosed, while at the same time allowing the drives to be steered, trimmed and tilted vertically. Tie-rod assembly 20 comprises a tubular rigid fixed length non-telescopic tie-rod 21 which is universally connected by connecting means 22 and 23 at opposite ends to a projection 24 on drives 12 and 13. Connecting means 22 and 23 include a universal coupling 25 and 26 which permits vertical relative movement between the drives through pins 27 and 28. The universal couplings 25 and 26 enable the drives 12 and 13 to assume different trim positions within a trim limit range.

As FIGS. 1 and 2 show, drive 12 is tiltable vertically by means of a pair of hydraulically operated extendable and retractable trim/tilt cylinders, such as 30, which may take the form of those cylinders disclosed in aforementioned U.S. Pat. Nos. 3,434,449 and 3,541,965. Cylinder 30 has its opposite ends pivotally connected by pivot means 31 and 32 to projections 33 and 24, respectively, on stationary mount 15 and housing 16, respectively, of drive 12. When the cylinders 30 are fully retracted, drive 12 assumes the full down position shown in FIGS. 1 and 2 and designated by the full down position line 34 in FIG. 2. When the cylinders 30 are fully extended, drive 12 assumes the full up or "trailer" position shown in phantom lines in FIG. 2 and designated by the full up position line 35 in FIG. 2. The cylinders 30 are operable to tilt or pivot drive 12 to full down or full up position or to any position therebetween, including trim positions within a trim angle or trim range $\theta$ between full down line 34 and a trim limit position line designated 36 in FIG. 2. The trim angle $\theta$ is the range within which drive 12 is typically positioned to effect trimming while boat 10 is running and the trim limit position line 36 is determined by the location, positioning or setting of a trim limit switch 55 for drive 12, as hereinafter described and shown in FIG. 5.

Figure 4:
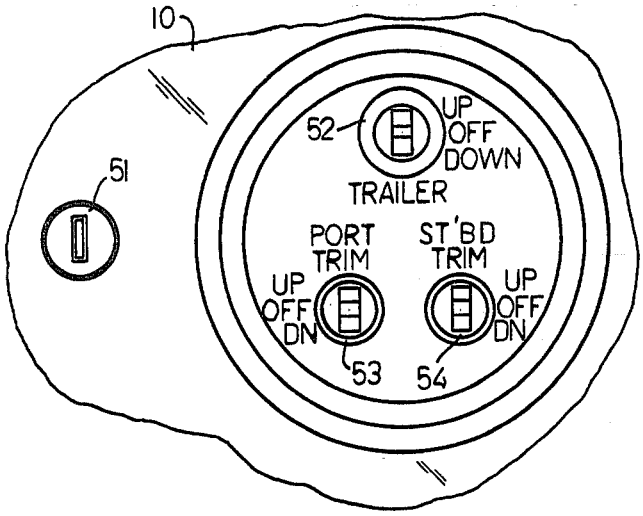
FIG. 4 is a front elevational view of a switch panel mounted on the boat operator's control console and containing three manually operable selector switches.

It is to be understood that drive 13, which as FIGS. 1 and 4 show is provided with trim/tilt cylinders 30, is also positionable in the same manner as drive 12.

The pair of trim/tilt cylinders 30 for port drive 12 are operated by an electro-hydraulic actuator system 40, shown schematically in FIG. 5, the specifics of which are not part of the present invention, except as follows: Actuator system 40 is connected by a pair of hydraulic fluid supply/return lines 41 to each cylinder 30 of drive 12 and is provided with four external electrical connection terminals designated ground terminal 42 connected to ground, main supply terminal 43, up terminal 44 and down terminal 45. Actuator system 40 may take the form of that disclosed in aforementioned U.S. Pat. No. 3,434,449 and is understood to comprise a hydraulic pump, a reversible electric motor for the pump, and other operating components, none of which are shown specifically in the drawings of the present specification. It is sufficient for purposes of the present specification to understand that actuator system 40 and its associated trim/tilt cylinder 30 for port drive 12 operate as follows: When terminals 42, 43, 44 and 45 are connected as shown in FIG. 5, energization of up terminal 44 effects extension of the trim/tilt cylinders 30 for drive 12 and upward tilting of drive 12 for as long as the terminal 44 is energized, whereas energization of down terminal 45 effects retraction of the trim/tilt cylinder 30 for drive 12 and downward tilting of drive 12 for as long as the terminal 45 is energized.

Figure 5:
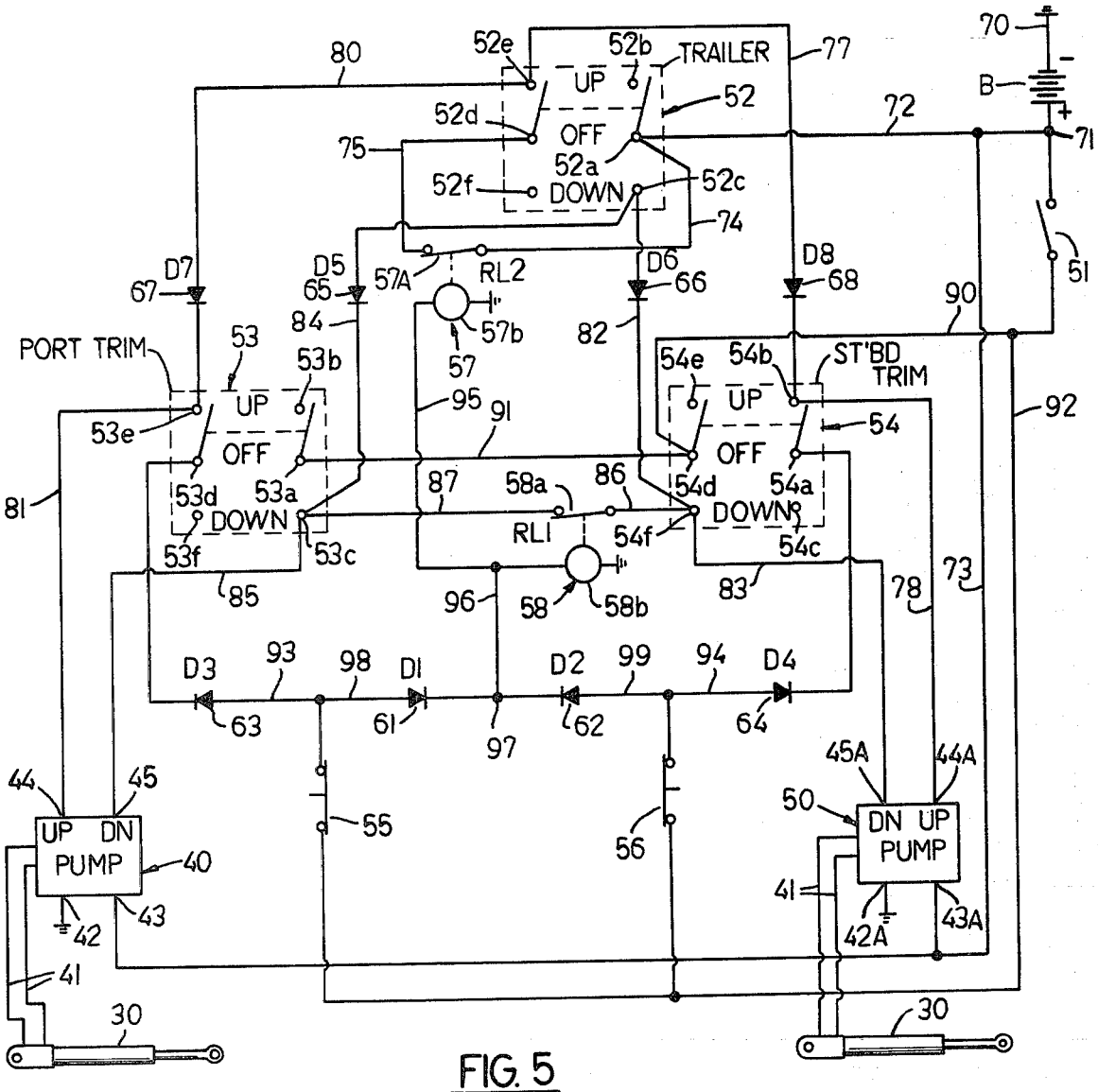
FIG. 5 is an electrical circuit diagram of an electrical control system in accordance with the present invention for tilting the drives of FIGS. 1, 2 and 3 by means of the switches of FIG. 4.

As FIG. 5 shown, the trim/tilt cylinders 30 of drive 13 are provided with an electro-hydraulic actuator system 50 which is similar in all respects to system 40 as hereinbefore described and has terminals designated 42A, 43A, 44A and 45A corresponding to the terminals 42, 43, 44 and 45, respectively, of actuator system 40.

Figure 3:
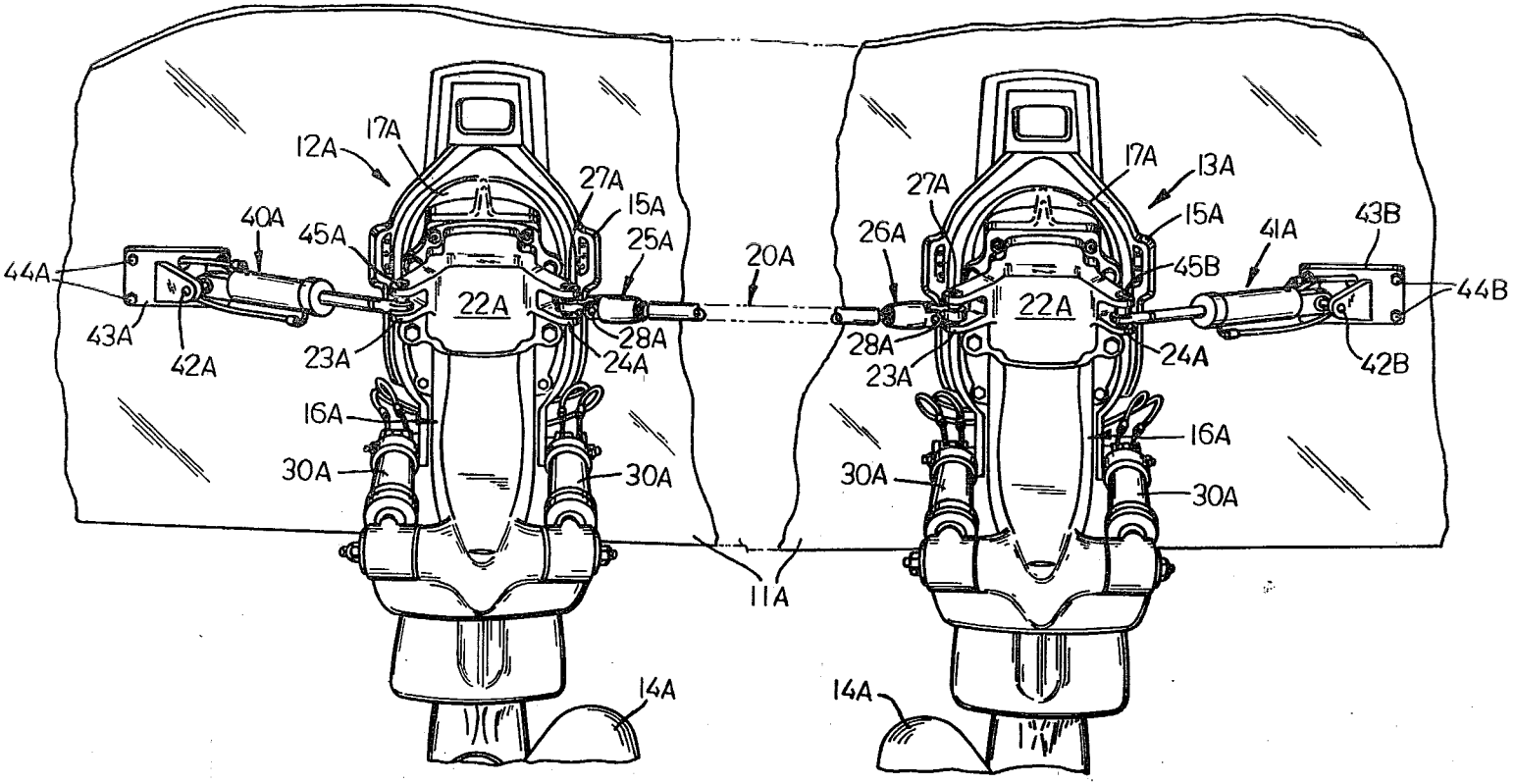
FIG. 3 is an end elevational view of the stern of a boat having two mechanically interconnected tiltable stern drives with externally mounted power steering cylinders.

FIG. 3 shows another embodiment of a pair of stern drives, designated 12A and 13A, which are dual mounted side-by-side on a boat transom 11A and interconnected by mechanical means, such as a tie-rod assembly or linkage 20A. Unlike the drives 12 and 13 hereinbefore described which are each pivoted about a vertical axis A—A for steering purposes by steering means located inside the boat, the drives 12A and 13A are pivoted about a vertical axis for steering purposes by a pair of power steering cylinders 40A and 41A which are located externally of boat transom 11A which are mechanically connected to the drive. However, it is to be understood that the drives 12A and 13A are pivotable horizontally and vertically in the same manner as the drives 12 and 13 and that the electrical control system shown in FIG. 5 and hereinbefore described is usable with the drives 12A and 13A, as well as the drives 12 and 13. Accordingly, the electrical control system is hereafter described specifically in connection with the drives 12 and 13.

As FIG. 3 shows, drives 12A and 13A are similar in construction and, therefore, only drive 12A is hereinafter described in detail. Drive 12A includes a drive unit 16A which is connected to transom 11A through a transom bracket 15A. Drive unit 16A includes a gimbal ring 17A which pivotably supports the drive unit for movement about a vertical axis for steering purposes and for movement about a horizontal axis for trimming. Drive unit 16A includes a propeller 14A and a suitable drive trim (not shown). Drive unit 16A is pivotable vertically by means of a pair of trim/tilt cylinders 30A, similar to cylinder 30 hereinbefore described.

Drive unit 16A is provided with a back cover bracket 22A which has a pair of rearwardly extending projections 23A and 24A. The tie-rod assembly 20A extends between and is universally connected by connecting means 25A and 26A to the projections 24A of stern drive 12A and to the projections 23A of stern drive 13A, respectively. Each connecting means 25A, 26A is understood to comprise a universal coupling which permits vertical relative movement between the drives through the pins 27A and 28A.

The power steering cylinder 40A has its cylinder end pivotably connected by a horizontally disposed bolt or pin 42A to a transom mounting bracket 43A which is rigidly secured to transom 11A by bolts 44A outboard of the stern drive 12A. The rod end of power steering cylinder 40A is pivotably connected by a vertically disposed bolt or pin 45A to the projection 23A of stern drive 12A. The power steering cylinder 41A has its cylinder end pivotably connected by a horizontally disposed bolt or pin 42B to a transom mounting bracket 43B which is rigidly secured to transom 11A by bolts 44B outboard of the stern drive 13A. The rod end of power steering cylinder 41A is pivotably connected by a vertically disposed bolt or pin 45B to the projections 24A of stern drive 13A.

Each steering cylinder 40A, 41A is of the double-acting type and, during a steering operation, one extends while the other retards, to apply steering force directly to the interconnected stern drives 12A and 13A. The horizontal and vertical disposition of the bolts 42A, 42B and 45A, 45B, respectively, permit the drive units of the stern drives 12A and 13A to pivot vertically in response to operation of the appropriate tilt cylinder 30A, as does the construction and arrangement of tie-bar assembly 20A.

The tie-bar assembly 20A and the steering cylinders 40A, 41A are mechanical means which, when connected to the drives as shown, permit independent vertical movement of the drive units 16A of the stern drives 12A and 13A at least within the trim range but prevent full independent vertical movement of the drive units relative to each other in either the trim range or the tilt range. The same holds true for the tie-bar assembly 20 of FIG. 1.

FIG. 5 shows an electrical control system in accordance with the invention for operating the electrohydraulic systems 40 and 50 for the drives 12 and 13, respectively. The control system is supplied from a storage battery B and comprises a main switch 51, three manually operable selector devices, such as electric switches (designated trailer switch 52, starboard trim switch 54, port trim switch 53), a pair of trim position limit switches (port switch 55 and starboard switch 56) which are understood to be mounted or located so as to be responsive to drive position, a pair of relays 57 and 58, and a plurality of circuit isolation diodes 61 through 68. The main switch 51 is preferably a key-operated single pole single throw switch associated with an ignition switch (not shown) for the boat. Each selector switch 52, 53, 54 as shown in FIGS. 4 and 5, is preferably a double pole double throw momentary switch having an off, up, and down position. The limit switches 55 and 56 are single pole single throw switches which are closed when their respective drives 12 or 13 are below the trim limit position, i.e., within the trim range $\theta$, and which are open when the drives are above the trim limit position line 36. The relays 57 and 58 are single pole single throw normally closed relays. The diodes 61 through 68 are used for isolation of the port and starboard circuit functions, as well as to prevent erratic system operation when more than one selector switch 52, 53, 54 is operated at the same time.

Negative terminal 70 of battery B is grounded. Positive terminal 71 of battery B is connected by a conductor 72 to movable contact **52*a* of trailer switch 52. Positive terminal 71 of battery B is alos connected by a conductor 73 to the main terminals 43 and 43A of the actuator systems 40 and 50, respectively. Movable contact 52*a* of trailer switch 52 is connected by a conductor 74 to one side of normally closed relay contact 57*a* of relay 57 and the other side of relay contact 57*a* is connected by a conductor 75 to movable contact 52*d* of trailer switch 52**.

Stationary up contact **52*e* of trailer switch 52 is connected by a conductor 77, which has diode 68 in series therein, to stationary up terminal 54*b* of starboard trim switch 54 and the latter terminal 54*b* is connected by a conductor 78 to up terminal 44A of actuator system 50. Stationary up contact 52*e* of trailer switch 52 is also connected by a conductor 80, which has diode 67 in series therein, to stationary up terminal 53*e* of port trim switch 53 and the latter terminal 53*e* is connected by a conductor 81 to up terminal 44 of actuator system 40**.

Stationary down contact **52*c* of trailer switch 52 is connected by a conductor 82, which has diode 66 in series therein, to stationary down terminal 54*f* of starboard trim switch 54 and the latter terminal 54*f* is connected by a conductor 83 to down terminal 45A of actuator system 50. Stationary down contact 52*c* of trailer switch 52 is also connected by a conductor 84, which has diode 65 in series therein, to stationary down terminal 53*c* of port trim switch 53 and the latter terminal 53*c* is connected by a conductor 85 to down terminal 45 of actuator system 40**.

Stationary down terminal **54*f* of starboard trim switch 54 is connected by a conductor 86 to one side of normally closed relay contact 58*a* of relay 58 and the other side of relay contact 58*a* is connected by a conductor 87 to stationary down terminal 53*c* of port trim switch 53**.

Positive terminal 71 of battery B is connected to one side of main switch 51 and the other side of main switch 51 is connected by a conductor 90 to the movable contact 54*d* of starboard trim switch 54 and movable contact 54*d* is connected by a conductor 91 to the movable contact 53*a* of port trim switch 53.

The said other side of main switch 51 is also connected by a conductor 92 to one side of the trim limit switches 55 and 56.

The other side of port trim limit switch 55 is connected by a conductor 93, which has diode 63 in series therein, to movable contact 53*d* of port trim switch 53.

The other side of starboard trim limit switch 56 is connected by a conductor 94, which has diode 64 in series therein, to movable contact 54*a* of starboard trim limit switch 54.

The relay coils 57*b* and 58*b* of the relays 57 and 58, respectively, each have one side connected to ground. The other sides of the relay coil 57*b* and 58*b* are connected to each other by a conductor 95 and the latter is connected by a conductor 96 to a point 97.

The said other sides of the trim limit switches 55 and 56 are also connected by conductors 98 and 99, respectively, to point 97. The conductors 98 and 99 have the diodes 61 and 62, respectively, connected in series therein and the diodes 61 and 62 are oppositely poled relative to each other.

Referring to FIGS. 4 and 5, the switches operate as follows. With the main switch 51 off (as when launching or trailing), trailer switch 52 "up" or "down" effects corresponding tilt of both drives 12 and 13 simultaneously to a desired position regardless of their initial position and the trim switches 53 and 54 are ineffective. With the main switch 51 on (as during boat operation), trailer switch 52 "down" effects down tilt of both drives 12 and 13 simultaneously to a desired position regardless of initial position, whereas trailer switch 52 "up" effects up tilt of both drives only if both drives are already above the trim range $\theta$. If both drives 12 and 13 are above the trim range $\theta$, either trim switch 53 or 54 "down" effects down tilt of both drives simultaneously, until the trim range $\theta$ is reached, but either trim switch 53 or 54 "up" has no effect. If both drives 12 and 13 are within the trim range $\theta$, either trim switch 53 or 54 "up" or "down" effects corresponding trim of the respective drive, but only within the trim range $\theta$.

The circuit shown in FIG. 5 operates generally as follows. With the main switch 51 off (open), the relays 57 and 58 remain de-energized and closed and the limit switches 55 and 56 have no effect on circuit operation. Therefore, trailer switch 52 "up" or "down" effects corresponding tilt of both drives 12 and 13 simultaneously regardless of their initial position. The trim switches 53 and 54 are totally ineffective because switch 51 is open and because of the operation of diodes 63 and 64.

With the main switch 51 on (closed), the relays 57, 58 and limit switches 55, 56 become operative. As before, trailer switch 52 "down" effects downtilt of both drives 12 and 13 simultaneously regardless of initial position. However, trailer switch 52 "up" effects up tilt of both drives only if both drives are already above the trim range $\theta$ and the limit switches are both open, thereby causing the relay coils to be de-energized and their contacts to be closed. If both drives 12 and 13 are above the trim range $\theta$, either trim switch 53 or 54 "down" effects down tilt of both drives simultaneously, until the trim range $\theta$ is reached, whereupon the limit switches close to energize the relays and open the relay contacts. Opening the contacts of one relay 58 isolates the port and starboard control portion of the control circuit. If both drives 12 and 13 are within the trim range $\theta$, either trim switch 53 or 54 "up" or "down" effects corresponding tilt only of the respective drive it controls. This occurs because relay 57 allows trailering up only when both drives have been raised and have reached their respective trim limit thereby opening the limit switches 55 and 56 and causing the relays 57 and 58 to be de-energized. The relay 58 allows both drives 12 and 13 to move down when either the port or starboard trim switches 53 or 54 are operated and the drives are above the trim limit range $\theta$. At the point that either drive 12 or 13 moving down reaches its trim limit and a trim limit switch 55 or 56 closes, the other relay 58 opens resulting in individual drive control.

The circuit shown in FIG. 5 operates more specifically as follows.

Operation With Main Switch Open

Assume initially that main switch 51 is open and that the selector switches 52, 53 and 54 are off (open). In this situation, the relay coils 57*b* and 58*b* are de-energized and their contacts 57*a* and 58*a*, respectively, are closed. Furthermore, the up terminals 44, 44A and the down terminals 45, 45A of the actuators 40 and 50, respectively, are de-energized, although the main terminals 43 and 43A of the actuators 40 and 50, respectively, are already energized from battery terminal 71 through conductor 73. Accordingly, the trim/tilt cylinders 30 for the drives 12 and 13, as well as the drives themselves, remain stationary in whatever position they are in. The condition of the limit switches 55 and 56 has no effect on circuit operation and, therefore, it is of no consequence whether the drives are within or above the trim range $\theta$.

Now assume that main switch 51 remains open (off) but that trailer switch 52 is actuated. If actuated up, an electrical circuit is established from battery terminal 71, through conductors 72, 74 (relay contact 57*a* is closed), 75 and through movable contact 52*d* to stationary up terminal 52*e* of trailer switch 52. Circuits are also established from terminal 52*e* through conductors 77, 78 to up terminal 44A of actuator 50 and from terminal 52*e* through conductors 80, 81 to up terminal 44 of actuator 40. Therefore, the actuators 40 and 50 effect extension of the cylinders 30 for the drives 12 and 13, respectively, causing the latter to pivot upward simultaneously for as long as trailer switch 52 is actuated up. If either trim switch 53 or 54 were actuated up while trailer switch 52 is up, the diodes 63 or 64, respectively, would prevent energization of the relays 57 and 58, respectively.

On the other hand, if switch 52 is actuated down, while main switch 51 is open (off), an electrical circuit is established from battery terminal 71 and through conductor 72 and through movable contact 52*a* to stationary down terminal 52*c* of trailer switch 52. Circuits are also established from terminal 52*c* through conductors 84, 85 to down terminal 45 of actuator 40 and from terminal 52*c* through conductors 82, 83 to down terminal 45A of actuator 50. Therefore, actuators 40 and 50 effect retraction of the cylinders 30 for the drives 12 and 13, respectively, causing the latter to pivot downward simultaneously for as long as trailer switch 52 is actuated down. Simultaneous actuation of either trim switch 53 or 54 in either direction while trailer switch 52 is down has no effect.

As is apparent, if main switch 51 is open (off), and trailer switch 52 is off, neither trim switch 53 or 54 can effect system operation regardless of which position it is placed in.

Operation With Main Switch Closed

Now assume that main switch 51 is closed (on) and that, initially, the selector switches 52, 53, 54 are off. As will be understood, in this situation the following conductors are always energized: conductors 72 and 74, conductors 90 and 91, conductor 73, conductor 92. Furthermore, the following contacts are always energized: the movable contacts 53*a* and 54*d* of the port and starboard trim switches 53 and 54, respectively; and movable contact 52*a* of trailer switch 52. Under these circumstances, the initial position of the drives 12 and 13 and, therefore, the condition of the limit switches 55 and 56 actuated thereby, determine the effect of actuation of the selector switches 52, 53, 54.

Drives Above Trim Limit

When main switch 51 is closed and both drives are above the trim limit position (i.e., above line 36 in FIG. 2), then both limit switches 55 and 56 are open and both relays 57 and 58 are off. In this situation actuation of trailer switch 52 up causes energization of both up terminals 44 and 44A of the actuator system 40 and 50, respectively, to raise both drives 12 and 13 simultaneously. This occurs because a circuit is established through closed relay contact 57*a* and conductor 75 to terminal 52*d* and up terminal 52*e* of trailer switch 52. Circuits are also established through conductors 80, 81 and 77, 78. If either trim switch 53 or 54 is actuated up while trailer switch 52 is up, the diodes 63 and 64 render switches 53 and 54 prevents energizing of the relays 57 and 58. However, if either trim switch 53 or 54 is actuated down while trailer switch 52 is up, the actuators 40 and 50 receive conflicting input signals and cease to operate the cylinder 30.

Furthermore, actuation of trailer switch 52 down causes energization of both down terminals 45 and 45A of the actuator systems 40 and 50, respectively, to lower both drives 12 and 13 simultaneously. Simultaneous up operation of either trim switch 53 or 54 has no effect and down actuation merely duplicates the down signal on the actuators. Such downward movement of both drives will continue as long as trailer switch 52 is held down, even when the limit switches 55 and 56 close (and thereby cause the relay coils 57*b* and 58*b* to energize and open their contacts 57*a* and 58*a*, respectively,) because the circuits from stationary down contact 52*c* do not include the relay contacts.

With main switch 51 is closed and both drives are above the trim limit position of line 36 (FIG. 2), then both limit switches 55 and 56 are open and both relays are off. In this situation, with trailer switch 52 off, up actuation of either or both trim switches 53 and 54 has no effect. However, down actuation of either (or both) trim switch 53 or 54 then will cause downward movement of both drives 12 and 13 simultaneously until the trim limit position is reached. More specifically, since the movable contacts 53*a* and 54*d* of the trim switches 53 and 54 are energized by means of the conductors 90 and 91, closure of either movable contact 53*a* or 54*d* with its respective down contact 53*c* or 54*f* causes energization of other other down contact 53*c* or 54*f* through conductors 86 and 87 as long as relay coil 58*b* remains de-energized and its relay contact 58*a* remains closed. However, when either or both drives 12 and 13 descend to the trim limit line 36 (FIG. 2) and either or both limit switches 55, 56 close, both relay coils 57*b* and 58*b* become energized and open their respective contacts 57*a* and 58*a*. When relay contact 58*a* opens, the circuit through conductors 86 and 87 between the trim switch contacts 53*c* and 54*f* opens. As a result, only that stationary down contact 53*c* or 54*f* which is in direct contact with its movable contact 53*a* or 54*d*, respectively, remains energized. Thus, the only down contact 45 or 45A on the actuators 40 or 50, respectively, which remains energized is that one associated with whichever contact 53*c* or 54*f* is energized.

Drives Below Trim Limit

As is apparent, assuming main switch 51 closed, whenever either or both drives 12 and 13 are within the trim range $\theta$, either or both trim limit switches 55 and 56 are closed and, as a result both relay coils 57*b* and 58*b* are energized and both relay contacts 57*a* and 58*a* open. As a result, trailer switch 52 up has no effect, whereas trailer switch 52 down causes simultaneous downward tilt of both drives. Furthermore, either trim switch 53 or 54 down effects only corresponding down tilt of its corresponding drive 12 or 13, respectively, as hereinbefore explained. In the latter case, for example, if movable contact 53*d* of port trim switch 53 is moved up and engages stationary up contact 53*e*, an electric circuit is established as follows: from battery terminal 71, through switch 51, through conductor 92, through the closed trim limit switch 55, through conductor 93, through switch contacts 53*d* and 53*e*, and through conductor 81 to up terminal 44 of actuator system 40. Diode 67 blocks energization of up terminal 44A of actuator system 50. Similarly, for example, if movable contact 54*a* of starboard trim switch 54 is moved up and engages stationary up contact 54*b*, an electric circuit is established as follows: from battery terminal 71, through switch 51, through conductor 92, through the closed trim limit switch 56, through conductor 94, through switch contacts 54*a* and 54*b*, and through conductor 78 to up terminal 44A of actuator system 50. Diode 68 blocks energization of up terminal 44 of actuator system 40.

The diodes 67 and 68 also prevent energization of up terminal 52*e* of trailer switch 52 from the trim switches 53 and 54, respectively. Similarly, the diodes 65 and 66 prevent energization of the down terminal 52*c* of trailer switch 52 from the trim switches 53 and 54, respectively.

I claim:

1. In combination:

a pair of drives mounted side-by-side on a watercraft, each drive being vertically movable in a trim range and in a tilt range;

mechanical means connected to said drives and permitting independent vertical movement of said drives within said trim range but preventing full independent vertical movement of said drives when either of said drives is outside of said trim range;

and control means for simultaneously moving both drives within said tilt range and for independently moving each drive within said trim range including first means operable to move both drives down simultaneously regardless of the initial drive position and to move both drives up simultaneously only if both drives are initially in said tilt range;

and second means operable to move both drives down simultaneously only if both drives are initially in said tilt range and only until at least one drive reaches said trim range, and to move either drive individually up or down only if both drives are initially in said trim range and only until the drive being moved reaches said tilt range.

2. A combination according to claim 1 wherein said control means includes a selectively operable selector device to effect operation of said first means and wherein said control means includes a pair of selectively operable selector devices to effect operation of said second means.

3. In combination:

a pair of drives mounted side-by-side on a watercraft, each drive being vertically movable in a trim range and in a tilt range;

mechanical means connected to said drives and permitting independent vertical movement of said drives at least within said trim range but preventing full independent vertical movement of said drives when either of said drives is outside said trim range;

and control means for simultaneously moving both drives within said tilt range and for independently moving each drive within said trim range, said control means including selectively operable selector devices for effecting movement of said drives, said control means further including:

first means operable in response to actuation of one of said selector devices to move both drives down simultaneously regardless of the initial drive position and to move both drives up simultaneously only if both drives are initially in said tilt range;

and second means operable in response to actuation of another of said selector devices to move both drives down simultaneously and if both drives are initially in said tilt range and only until at least one drive reaches said trim range, and to move one drive individually up or down only if both drives are initially in said trim range and only until the drive being moved reaches said tilt range.

4. A combination according to claim 3 wherein said control means includes a selectively operable device to effect operation of said first means and wherein said control means includes a pair of selectively operable selector devices to effect operation of said second means.

5. A combination according to claim 4 wherein said control means includes electrical control means and wherein said selectively operable selector devices are electric switches.

6. A combination according to claim 3 wherein said mechanical means includes a tie-bar connected between said drives.

7. A combination according to claim 3 or 6 wherein said mechanical means further includes power steering cylinders connected to said drives.

8. In combination:

a pair of drives mounted side-by-side on a watercraft, each drive being vertically movable in a trim range and in a tilt range;

mechanical means connected to said drives and permitting independent vertical movement of said drives at least within said trim range but preventing full independent vertical movement of said drives when either of said drives is outside said trim range;

and control means for simultaneously moving both drives within said tilt range and for independently moving each drive within said trim range, said control means including selectively operable selector devices for effecting movement of said drives and means responsive to the position of said drives, said control means being operable in response to actuation of one of said selector devices and to said means responsive to the position of said drives to move both drives down simultaneously regardless of the initial drive position and to move both drives up simultaneously only if both drives are initially in said tilt range;

said control means being further operable in response to actuation of another of said selector drives and to said means responsive to the position of said drives to move both drives down simultaneously only if both drives are initially in said tilt range and only until at least one drive reaches said trim range, and to move one drive individually up or down only if both drives are initially in said trim range and only until the drive being moved reaches said tilt range.

9. A combination according to claim 8 wherein said control means includes three selectively operable switches, each switch being actuatable to an off, up and down position.

10. A combination according to claim 9 wherein said means responsive to the position of said drives includes a pair of limit switches, one for each drive unit.

11. A combination according to claim 8 wherein said control means further includes relay means controlled by said means responsive to the position of said drives to control the operation of said selectively operable switches.

* * * * *